United States Patent [19]

Tracy

[11] 4,339,019

[45] Jul. 13, 1982

[54] SAFETY CHUTE

[75] Inventor: Thomas R. Tracy, Boise, Id.

[73] Assignee: Palladium Corporation, Boise, Id.

[21] Appl. No.: 137,619

[22] Filed: Apr. 7, 1980

[51] Int. Cl.[3] ..... A62B 1/20

[52] U.S. Cl. ..... 182/47; 182/48; 193/25 R

[58] Field of Search ..... 182/48, 49, 10, 46, 182/47; 193/25 R

[56] References Cited

U.S. PATENT DOCUMENTS

| | | | |
|---|---|---|---|
| 908,034 | 12/1908 | Pyleck | 193/25 R |
| 1,006,689 | 10/1911 | Schwarz | 182/48 |
| 1,520,440 | 12/1924 | Pyleck | 193/25 R |
| 4,005,762 | 2/1977 | Zephinie | 182/48 |
| 4,099,595 | 7/1978 | Tracy | 182/48 |
| 4,099,596 | 7/1978 | Tracy | 182/48 |

FOREIGN PATENT DOCUMENTS 2531169 5/1976 German Democratic Rep. ... 182/48

*Primary Examiner*—Reinaldo P. Machado
*Attorney, Agent, or Firm*—Norris & Bateman

[57] ABSTRACT

An emergency escape apparatus for speedily evacuating workers or others from a high level platform or the like comprising a longitudinally folded tubular escape chute slidably connected to an angularly disposed cable, the chute being held in folded condition by a cover that may be speedily opened to release the chute for unfolding deployment down and along the cable, and the chute being of multisleeve construction with the outer layer of fire resistant material. The apparatus may be used for other purposes than emergency escape, for example as a slide chute in an amusement park.

4 Claims, 19 Drawing Figures

Fig. 2
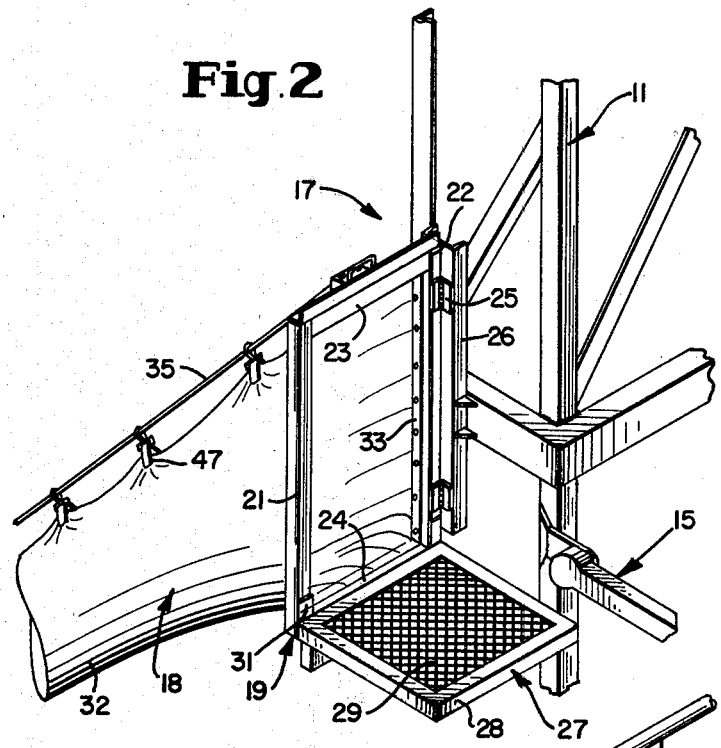
Fig. 2A
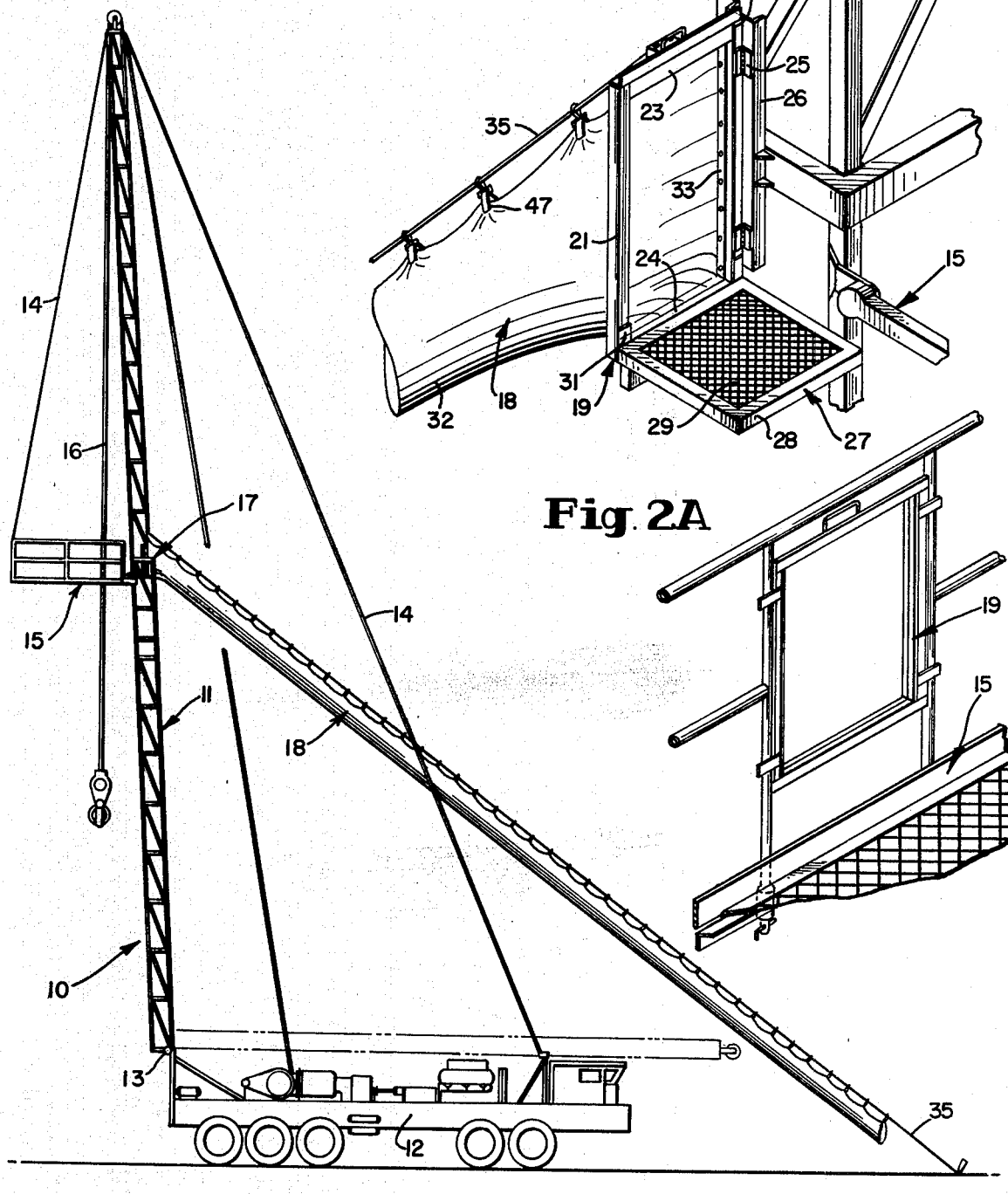
Fig. 1

Fig. 5
Fig. 4
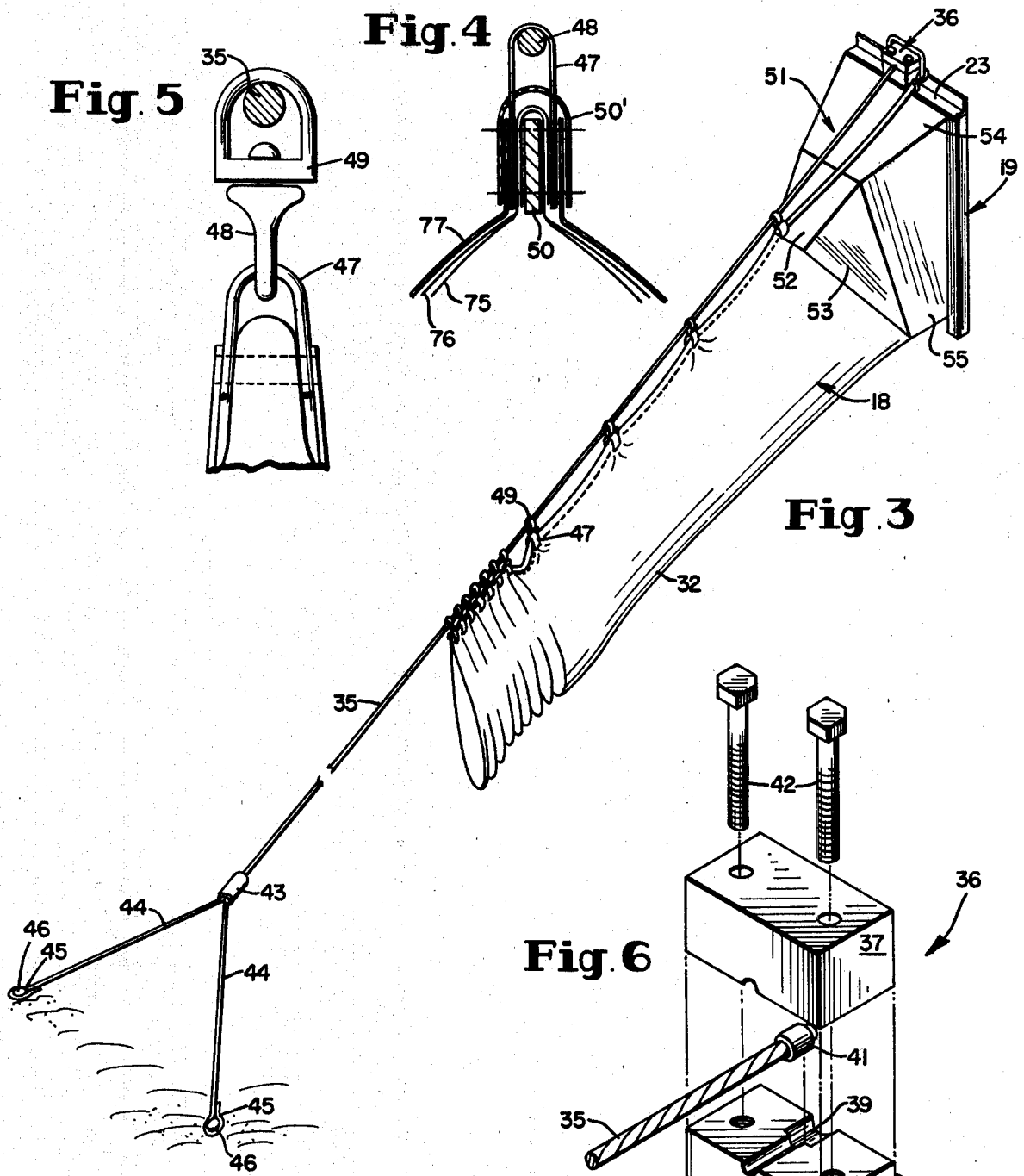
Fig. 3
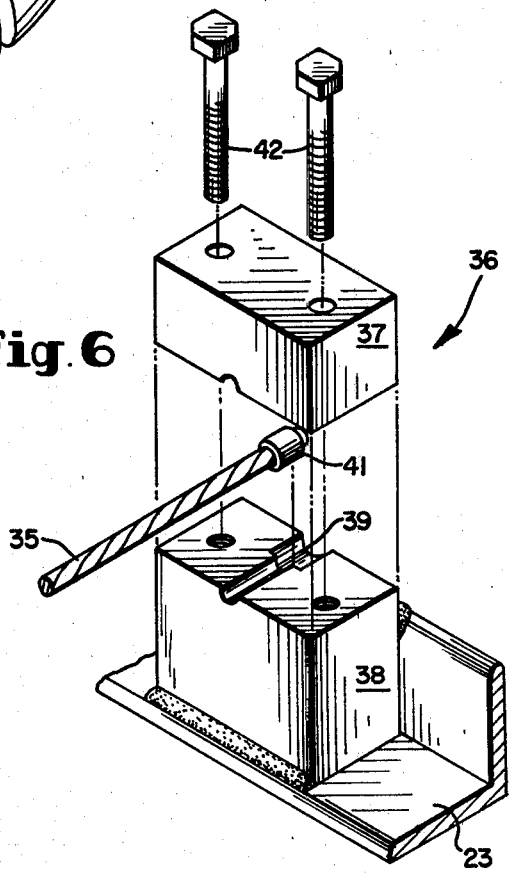
Fig. 6
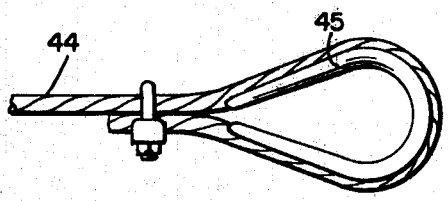
Fig. 7

Fig. 14
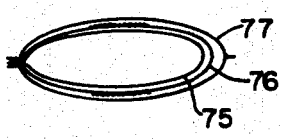
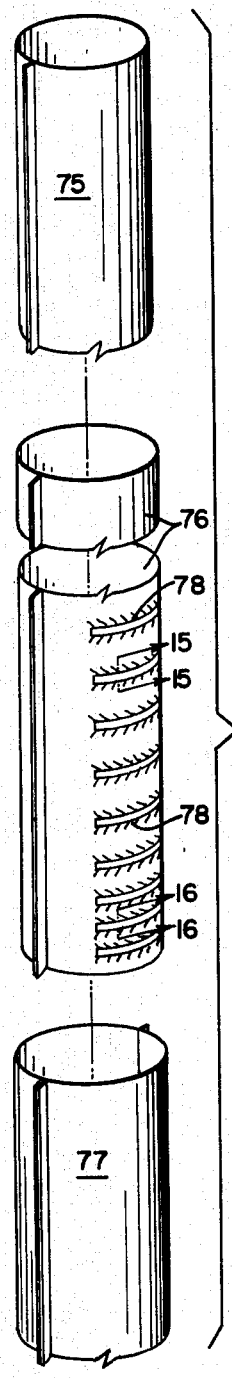
Fig. 13
Fig. 17
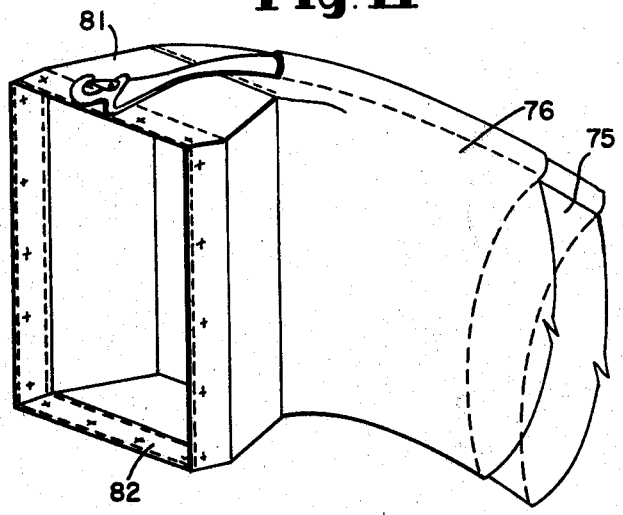
Fig. 18
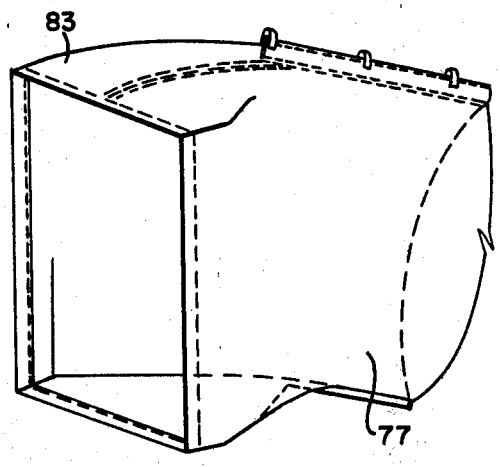
Fig. 15
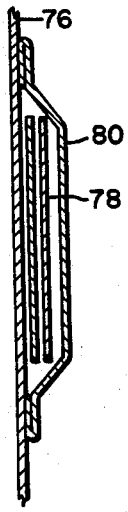
Fig. 16
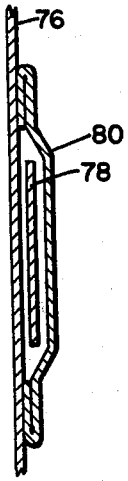

SAFETY CHUTE

This invention relates to safety chutes enabling rapid safe evacuation of persons working or otherwise occupied in a location well above the ground, usually on a platform that might encounter a sudden fire or other danger requiring instant escape, and particularly to the packing, release and deployment of such chutes.

In its preferred embodiment the invention will be specifically disclosed as embodied in an oil rig or the like subject to flash fires, but the principles and structure may be used for escape from other dangerous structures such as burning buildings, and from other high level platforms.

Emergency escape chutes of this general type are disclosed in my earlier U.S. Pat. Nos. 4,099,595 and 4,099,596 and the inventions of those patents may be included in the present invention.

The present invention contemplates improvement over the above-mentioned patents, mainly in structural detail relating to compact packing and ready release and guided deployment of a relatively lightweight folded escape chute assembly adapted to withstand high heat environments, and such is the major object of the invention.

Another object of the invention is to provide a novel safety chute assembly that is longitudinally folded into a pack, as on a frame mounted at a high level platform or other location, and a guide cable extending at an acute angle from the pack to ground, with the chute so connected to the cable that upon release at the pack the chute will slide down and deploy unfolding along the cable.

A further object of the invention is to provide a novel longitudinally folded safety chute assembly wherein the chute is held in a folded pack by a cover, and the cover is fully opened by a quick release arrangement enabling the chute to immediately unfold mainly under the influence of gravity.

Another object of the invention is to provide a novel safety chute construction comprising at least three coextensive sleeves or layers, an inner slipper sleeve which may be a polyester fabric, an intermediate sleeve which may be nylon fabric, and an outer heat resistant sleeve which may be an aluminized glass fiber fabric. Pursuant to this object the intermediate sleeve, at least in its lower deployed half, is provided with longitudinally spaced deceleration restrictions for slowing passage of a body down the chute to a safe speed of descent.

Further novel features and other objects of this invention will become apparent from the following detailed description, discussion and the appended claims taken in conjunction with the accompanying drawings.

BRIEF DESCRIPTION OF DRAWINGS

FIG. 1 is a side elevation showing the invention in a preferred embodiment, with the evacuation safety chute unfolded and deployed;

FIG. 2 is a fragmentary view showing one mode of mounting of the chute assembly on the mast of a drill rig;

FIG. 2A is a fragmentary view showing another mode of mounting the chute assembly on a drill rig or the like;

FIG. 3 is a fragmentary view at the front of the evacuation chute particularly showing the cable slide;

FIG. 4 is a fragmentary section showing detail of chute structure where it is suspended from the cable;

FIG. 5 is a fragmentary view showing the swivel slide attachment of the chute to the cable;

FIG. 6 is a fragmentary exploded view showing the fixed attachment clamp for securing the upper end of the cable of FIG. 3 to the frame;

FIG. 7 is a fragmentary view showing one of the lower end cable anchor loops;

FIG. 13 is an exploded view showing a chute sleeve structure according to a preferred embodiment;

FIG. 14 is a top view showing the multi-layer nature of the chute;

FIGS. 15 and 16 are fragmentary sections substantially at lines 15—15 and 16—16 in FIG. 13;

FIG. 17 is a view showing the yoke forming upper ends of the inner and intermediate sleeves; and FIG. 18 is a similar view showing the yoke incorporated upper end of the outer heat resistant sleeve.

PREFERRED EMBODIMENTS

Figure 8:
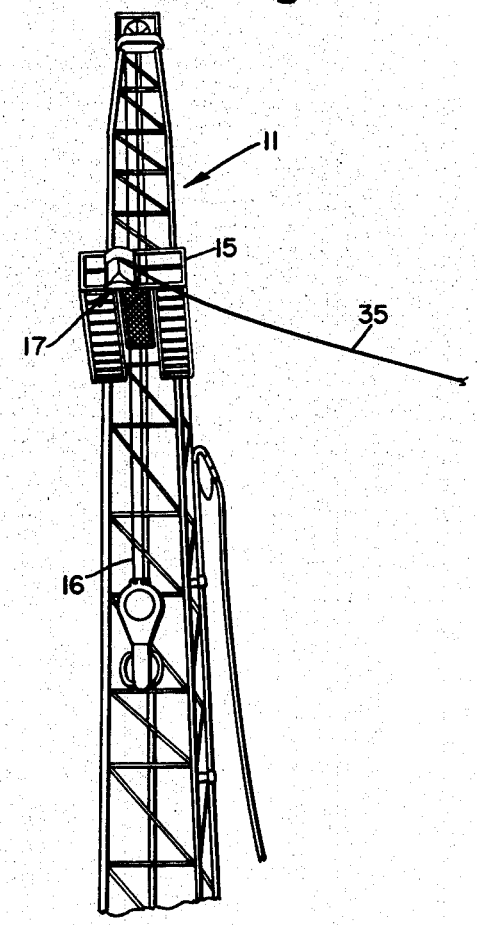
FIGS. 8 and 9 are elevational views showing the upper end of the mast before and after deployment of the evacuation chute.

FIG. 1 shows the invention as applied to a conventional type mobile well drilling equipment 10 such as used in drilling oil wells.

A vertical mast 11 is mounted on a vehicle 12. This mast is usually hinged at its lower portion at 13, so that it may be folded down to the dotted line condition of FIG. 1 during transport, the upper portion usually being detached and separately transported until the vehicle reaches the point of use where it is attached and the mast raised to the vertical upright full line position of FIG. 1 and supported by the guy wires 14.

Near the upper end of the lower portion of the mast is a fixed platform 15 on which during installation and drilling operations one or more persons stand.

All of the foregoing is conventional including whatever drilling or material handling equipment such as at 16 (FIGS. 8 and 9) may be suspended from the mast, and connections to operating devices on the vehicle or at the platform.

The invention here relates to the provision of safety escape means in the region indicated at 17 in FIG. 1 and available for instant evacuation of the operator or operators who might be working on platform 15 should there be a fire blast arising from the well being drilled.

This escape unit 17 includes an evacuation slide chute assembly 18 initially prepacked upon an open frame 19. Preferably the chute is packed on the frame before the frame is mounted on the mast. As shown in FIG. 2 the frame 19 has parallel side walls 21–24 defining a hollow rectangle of sufficient size to easily accomodate a man quickly entering it. For example the opening defined by frame 19 may be about four feet high and two feet wide. The frame sides are usually covered with a fabric for Velcro fastener attachment of the cover later described.

One side of the frame may be hingedly mounted on the mast 11, side wall 23 being connected by vertical axis hinges 25 to a vertical bar 26 welded to or otherwise rigid with the mast. The hinges may be readily disassembled removing the frame for repacking the chute after use or substituting a prepacked and covered frame and folded chute assembly. A step member 27 comprising a frame 28 mounted a wire mesh panel 29 strong enough to support a man is hinged about a horizontal axis at 31 to the lower side 24 of frame 19. Frame 19 is located near the inner end of fixed platform 15 in such position that the worker may very quickly step off platform 15 onto the step.

As shown in FIG. 2 the upper end of flexible tube 32 of the slide chute assembly is open and fixedly secured to frame 19 by a rectangular strip subframe 33. When the safety means is in the inoperative condition such as shown at FIG. 8 the chute assembly 18 is packed substantially flat with frame 19, step member 27 is folded up against frame 19, and frame 19 is swung inwardly to a substantially flush position relative to mast 11.

Figure 9:
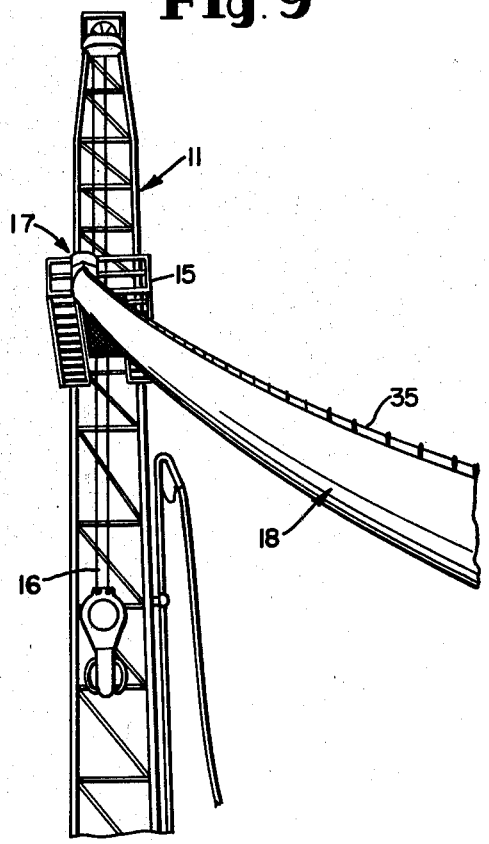

Alternatively the bar 26 carrying the assembly may be mounted on side rails of platform 15, so that the frame 19 containing the packed tube 32 may be swung to a position along the side rails as indicated in FIGS. 8 and 9. Further alternatively the frame 19 may be fixedly or removably mounted in a gap in the side rail of platform 15 as shown in FIG. 2A. The essential structure and operation of the safety means are the same regardless of how it is mounted at the platform.

As shown in FIGS. 1, 2, 3, 8 and 9 a flexible cable 35 extends from the safety unit 17 angularly to the ground below. As will appear this cable serves to guide the tube 32 as it unfolds during deployment and to support the weight of the tube 32 and anyone descending through it during an emergency rescue operation. Cable 35 is preferably a braided steel cable of adequate strength.

The upper end of cable 35 is fixed in a cable clamp 36, that may comprise upper and lower blocks 37 and 38 having flat interfaces formed with stepped recess means 39 adapted to receive the cable end and an enlarged fixed button 41. The lower block 38 is secured as by welding to the top side 23 of frame 19, and the blocks when secured together by machine screws 42 securely clamp the cable end on frame 19.

At its lower end cable 35 enters a fitting 43 wherein it is attached to branched anchor cable terminals 44 that extend within an included angle of about 45° to be formed into loops 45 that are passed over pins 46 driven into the ground.

Cable 35 is preferably drawn fairly taught, and it extends at a suitable angle with respect to the vertical mast. Preferably the angle is at least about 30° relative to the vertical and may be about 60° relative to the vertical, the angle being selected for reasons that will later appear. Preferably the maximum angle allowing safe descent at the particular platform level is used, to convey the worker as far as possible away from the danger area.

With initial reference to FIGS. 3–5 the tube 32 is longitudinally flexible and preferably has a special wall construction such as shown in FIG. 13 and later to be described. A series of loop straps 47 are secured to the tube wall at equally spaced intervals and each of these straps is connected to ring like swivel connections 48 and 49, through which cable 35 is threaded.

Referring to FIG. 4, it is preferable that narrow longitudinal edges of the sleeves 75 and 76 be looped to enclose and be secured to a flexible ridge strap 50. As shown in FIG. 3 the upper end of the ridge strap 50 is secured to the frame 19. Opposite longitudinal edges of the heat shield sleeve are secured at each side of the ridge strap, and a U-shaped shield strip 50' of the heat resistant material extends the length of the tube.

At its upper end the tube 32 is formed with a transition section 51 in the form of a panelled yoke wherein the generally cylindrical or ovate cross section changes to the rectangular door entry shape of frame 19. This yoke section 51 comprises panels including panels 52–55 diagrammatically shown in FIG. 3 that accordian fold toward the frame 19 when the cylindrical portion of the tube is longitudinally collapsed toward the frame.

Figure 10:
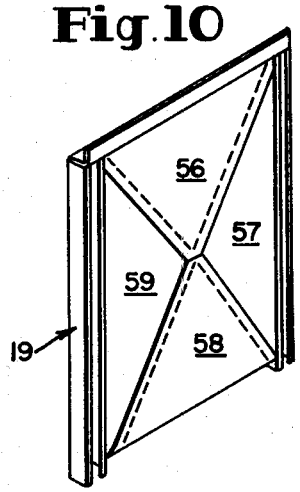
FIG. 10 is an end view facing the evacuation chute pack as it appears to a person about to make a slide descent.

FIG. 10 shows the preferred easily openable entry door arrangement which will face the worker who is about to enter the slide assembly. This door arrangement comprises four triangular panels 56–59 of nylon or the like secured along their bases to the sides of frame 19 and having overlapping edges usually embodying so-called Velcro fasteners. These fasteners will retain the panels during normal shipping and non-use of the system, but they will readily release and allow free inward folding of the panels upon impact of a human body.

Figure 11:
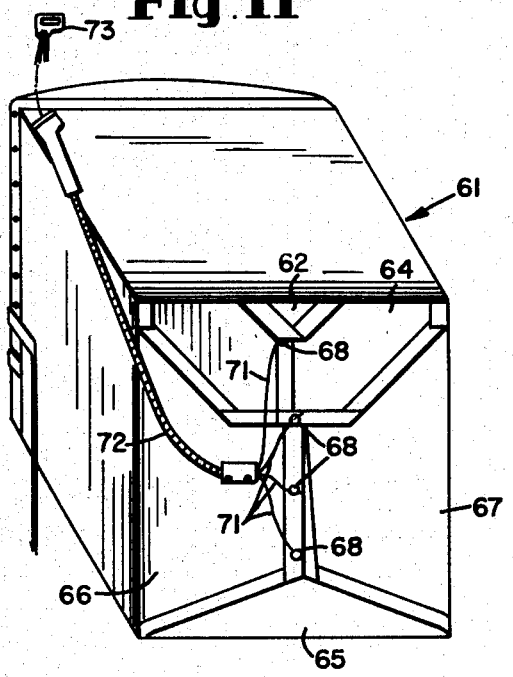
FIG. 11 is a view at the opposite end of the chute pack of FIG. 10 showing the covered pack.

FIG. 11 shows a cover arrangement 61 over the entire unit. This comprises a bag-like unit slipped over the unit 17, with an opening flap 62 through which may pass the cable 35. The cover 61 has an open end that extends around the frame 19 and is secured to the frame covering material as by Velcro fastening means. This cover holds the chute assembly in its collapsed form against the outer end of frame 19 and when opened release the tube 32 to start the folded freed leading end sliding down the cable 35 until unfolded to full deployment.

Figure 12:
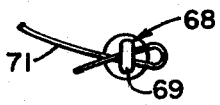
FIG. 12 is a fragmentary view showing a release pin arrangement for maintaining the retraining cover on the folded chute.

As shown in FIG. 11 the cover 61 which extends over the folded chute assembly outwardly from the frame 19 may comprise upper and lower flaps 64 and 65 and side flaps 66 and 67 folded toward each other and maintained in closed cover condition by release keeper pins 68 that extend through the overlapped flap edges. As shown in FIG. 12, each pin has an eye 69 at its outer end through which is looped the end of a pull cord 71, the pull cords 71 extending through a sheath 72 to terminate in a manual release handle 73 that is available at the top of the cover near frame 19. In operation when a person seeks to descend the chute he pulls on the handle 73 which operates pull cords 71 to pull out pins 68 thereby freeing flaps 64–67 so that they no longer restrain the folded chute. The freed end of the packed chute now forces the flaps open and leaves the cover and deploys down the cable 35 by gravity, unfolding as it goes. The overall weight of the packed chute is about 150–250 pounds. Immediate dropping away of the chute due to gravity is ensured because as shown in FIGS. 3 and 11 the yoke portion inclines somewhat downwardly.

Referring to FIGS. 4 and 13, the tubular chute comprises inner sleeve layers 75 and 76, and a sleeve outer layer 77 all coextensive. The innermost sleeve layer 75 is preferably of some smooth slippery low friction material such as the polyester fabric known as Dacron. Its function is to offer no surface resistance to a body sliding down the chute. The intermediate sleeve layer is likewise a synthetic fabric, usually nylon, and as will appear in connection with FIG. 13, the restriction zones for regulating descent of a body through the chute are mounted on this sleeve. Layers 75 and 76 are circumferentially secured together at their upper ends where they are attached to the frame 19 and are circumferentially secured together around their lower edges, but may be otherwise non-attached and freely relatively movable longitudinally. The outer layer 77 is of fire and heat resistant material, preferably an aluminized glass fiber fabric.

The middle layer sleeve 76 as shown in FIG. 13 has a longitudinally spaced series of restriction zones, provided by external elastic straps or bands 78 fixed on the layer so as to circumferentially gather the fabric and locally restrict the cross section. Preferably these straps 78 each extend about halfway around the sleeve, as disclosed in my earlier U.S. Pat. No. 4,099,595.

In the present invention however as indicated in FIG. 13, there are no restriction zones for a considerable usually major region along the sleeve, typically the upper 50% of the length of the sleeve. The purpose of this is to allow the body falling down through the chute to initially move as rapidly as possible away from the fire or other danger situation. Below that region the spaced straps are secured to the sleeve and deceleration starts at the lower end as shown the straps are more closely spaced longitudinally to effect stronger deceleration as the body nears the open end of the chute. In practice it has been satisfactory to locate the upper series of straps 78 about three feet apart along the sleeve and the lower straps spaced about half that distance.

As shown in FIGS. 15 and 16 the straps may be enclosed in fabric loops 80 secured on the sleeve with opposite ends attached to the sleeve, and the straps may be doubled or of double thickness in the upper restriction zones where the deceleration effect abruptly starts.

As shown in FIG. 17 the sleeves 75 and 76 coextensively terminate at their upper ends in transition shapes 81 and are attached to the frame around end rim 82. Similarly as shown in FIG. 18 the upper end of outer heat resistant layer 77 has a transition shape 83 to extend over the inner layers and be secured to the frame. This transition shape defines the yoke 51 of FIG. 3.

In operation of the safety chute, when a fire or like dangerous situation occurs the worker on the platform may immediately pull the rip cord handle 73 to release the chute which by gravity deploys down the cable. Then the worker inserts himself feet first through the frame, the flaps 56–58 readily parting to allow his passage, and he slides down inside the deployed chute. The deployed tube due to the angularity of the cable speedily moves the occupant of the chute away from the site of the fire. In an oil rig installation for example the open end of the tube may be 45–50 feet away from the rig and terminate about three feet above the ground. A suitable landing pad is usually provided below the open lower end. For about half the distance the worker slides with increasing acceleration, thereby moving as fast as possible in a protected environment away from the fire. Deceleration starts when he reaches the elastic restriction provided by straps 78, and he slows to a safe speed of descent through the remainder of the tube.

The slide of the invention incorporates a further deceleration feature by reason of its special construction. As above explained the sleeves 75 and 76 are circumferentially secured together at their lower ends. As the chute deploys it rapidly fills with air. As the body rapidly descends through the tube it pushes the column of air ahead of it creating a condition wherein, although some of the air escapes through the open end of the tube a large volume accumulates and essentially tends to balloon the chute above the opening. This together with the increased restriction offered by the more closely spaced elastic straps near the lower end of the chute causes the lower edge of the lining to sphincter or reduce the effective chute opening temporarily. This phenomenon coupled with the restricting action of the elastic bands combines to enable safe descent of human body without the person making any effort to slow his descent. Thus injured persons may be thrust into the top of the chute and arrive safely at the bottom.

While the apparatus of the invention is disclosed as for emergency escape it can be used in other environments such as a safe slide chute in an amusement park.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range by equivalency of the claims are therefore intended to be embraced therein.

What is claimed and desired to be secured by Letters Patent is:

1. An emergency escape apparatus for a structure having a working or like platform disposed at considerable distance above ground level, said apparatus comprising means defining an escape chute entrance adapted to be flexibly mounted at said platform, a cable extending from said entrance at an acute angle to the ground below, a flexible longitudinally collapsible tubular escape chute secured at one end to said entrance and slidably connected to said cable, said chute normally being longitudinally collapsed into a releasable pack at said entrance and releasably held in folded condition by a bag like cover which extends over the folded chute and is closed at the side opposite the chute entrance by flaps secured by keeper pins, and means accessible to a person about to enter the entrance end of the chute for releasing the cover to allow automatic unfolding of the chute to deploy along the cable, comprising a rip cord arrangement actuatable to speedily remove all of the pins and allow the folded pack end to move through the open flaps, said chute being adapted when released to slide down the cable while longitudinally deploying along the cable to define a continuous escape tube suspended along said cable.

2. An emergency escape apparatus for a structure having a working or like platform disposed a considerable distance above ground level, said apparatus comprising means defining an escape chute entrance adapted to be fixedly mounted at said platform, a cable extending from said entrance at an acute angle to the ground below externally of said chute, a flexible longitudinally collapsible tubular escape chute secured at one end to said entrance and slidably connected to said cable, said chute comprising an inner layer of synthetic plastic material, an intermediate layer of synthetic plastic material having at least along the lower portion of its length longitudinally spaced plurality of deceleration imparting restriction means, and an outer heat resistant layer, said chute being normally longitudinally collapsed into a releasable pack at said entrance and being adapted, when released, to slide down the cable while longitudinally deploying along the cable to define a continuous escape tube suspended along said cable, said inner and intermediate layers being secured together circumferentially at their lower ends to form a column of trapped air between said inner and intermediate layers to assist in the deceleration of a person passing through said chute.

3. An emergency escape apparatus for a structure having a working or like platform disposed a considerable distance above ground level, said apparatus comprising a frame hinged to said structure to move to an inoperative position adjacent said structure, said frame defining an escape chute entrance, a step member hingedly connected to the lower end of said frame, said step member being folded up against the frame when the frame is in inoperative position, said step member being folded down to extend at right angles to the frame when the frame is in operative position, a cable extending from said entrance at an acute angle to the ground below, and a flexible longitudinally collapsible tubular escape chute secured at one end around said frame and slidably connected to said cable, said chute being normally longitudinally collapsed into a releasable pack at said entrance and being adapted, when released, to slide down the cable while longitudinally deploying along the cable to define a continuous escape tube suspended along said cable.

4. An emergency escape apparatus for a structure having a working or like platform disposed a considerable distance above ground level, said apparatus comprising a frame adapted to be fixedly mounted at said platform, a cable extending from said frame at an acute angle to the ground below, a flexible longitudinally collapsible escape chute secured at one end to said frame and slidably connected to said cable, said chute comprising an inner layer of low friction material, an intermediate layer of synthetic plastic material having at least along the lower portion of its length a longitudinally spaced plurality of deceleration imparting restriction bands and an outer heat resistant layer, said chute being normally collapsed and releasably held in a folded condition by a cover, means accessible to a person about to enter the entrance end of the chute for releasing the cover to allow automatic unfolding of the chute to deploy along the cable, a plurality of flaps normally extending over the frame to close the entrance to said chute, said flaps being only lightly held together normally so as to be readily displaced to open the chute in an emergency, said chute being adapted when released to slide down the cable while longitudinally deploying along the cable to define a continuous escape tube suspended along said cable, and said inner and intermediate layers being circumferentially secured together substantially air tight at their lower edges to form a trapped column of air between said inner and intermediate layers to assist in the deceleration of a person passing through said chute.

* * * * *